US007762244B2

(12) United States Patent
Aliakbarzadeh

(10) Patent No.: US 7,762,244 B2
(45) Date of Patent: Jul. 27, 2010

(54) METHOD AND DEVICE FOR ADAPTING THE RECORDING OF A MEASURED SIGNAL FOR AN EXHAUST PROBE

(75) Inventor: Reza Aliakbarzadeh, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 357 days.

(21) Appl. No.: 11/989,176

(22) PCT Filed: Jun. 30, 2006

(86) PCT No.: PCT/EP2006/063743

§ 371 (c)(1),
(2), (4) Date: Jan. 22, 2008

(87) PCT Pub. No.: WO2007/012542

PCT Pub. Date: Feb. 1, 2007

(65) Prior Publication Data

US 2009/0090338 A1 Apr. 9, 2009

(30) Foreign Application Priority Data

Jul. 25, 2005 (DE) ..... 10 2005 034 690

(51) Int. Cl.
*F02D 41/00* (2006.01)
*F02D 41/14* (2006.01)
*F01N 9/00* (2006.01)

(52) U.S. Cl. ..... 123/693; 123/568.11; 701/108

(58) Field of Classification Search ..... 123/693, 123/698, 700, 568.11; 701/108
See application file for complete search history.

(56) References Cited

U.S. PATENT DOCUMENTS 7,503,320 B2 * 3/2009 Collet ..... 123/698
2008/0120017 A1 * 5/2008 Rodatz et al. ..... 701/108

FOREIGN PATENT DOCUMENTS

DE 199 03 721 C1 7/2000
DE 103 04 245 B3 7/2004
DE 10 2004 004 291 B3 1/2005
EP 1 431 557 A2 6/2004

* cited by examiner

*Primary Examiner*—Hieu T Vo
(74) *Attorney, Agent, or Firm*—King & Spalding, L.L.P.

(57) ABSTRACT

An exhaust probe is arranged on an internal combustion engine with multiple cylinders and the injection valves provided for the cylinders measure the fuel. The exhaust probe is arranged on an exhaust manifold, and the measured signal is characteristic of the air/fuel ratio in the corresponding cylinder. The measured signal is recorded at a given crankshaft angle with relation to a reference position for the piston and allocated to the corresponding cylinder. A set parameter for adjustment of the air/fuel ratio in the corresponding cylinder is generated depending on the measured signal recorded for each cylinder. The given crankshaft angle is adjusted depending on a value criterion which depends on a uneven running of an output shaft from the internal combustion engine.

15 Claims, 6 Drawing Sheets

METHOD AND DEVICE FOR ADAPTING THE RECORDING OF A MEASURED SIGNAL FOR AN EXHAUST PROBE

CROSS REFERENCE TO RELATED APPLICATIONS

This application is the U.S. National Stage of International Application No. PCT/EP2006/063743, filed Jun. 30, 2006 and claims the benefit thereof. The International Application claims the benefits of German application No. 10 2005 034 690.1 filed Jul. 25, 2005, both of the applications are incorporated by reference herein in their entirety.

FIELD OF INVENTION

The invention relates to a method for adapting the acquisition of a measurement signal of an exhaust probe which is disposed in an internal combustion engine having a plurality of cylinders and fuel-metering injection valves associated with said cylinders. The exhaust probe is disposed in an exhaust tract and its measurement signal is characteristic for the air/fuel ratio in the respective cylinder.

BACKGROUND OF THE INVENTION

Increasingly stringent legal provisions in respect of permissible pollutant emissions from motor vehicles powered by internal combustion engines make it necessary to minimize the pollutant emissions during operation of the internal combustion engine. This can be achieved on the one hand by reducing the pollutant emissions produced during combustion of the air/fuel mixture in the particular cylinder of the internal combustion engine. On the other hand, exhaust after-treatment systems are used in internal combustion engines to convert the pollutant emissions produced during the combustion process of the air/fuel mixture in the respective cylinders into harmless substances. For this purpose, catalytic converters are used which convert the carbon monoxide, hydrocarbons and nitrogen oxides into harness substances. Selectively controlling the generation of the pollutant emissions during combustion and converting the pollutants with a high degree of efficiency by means of a catalytic converter both require a very precisely adjusted air/fuel ratio in the particular cylinder.

In order to be able to meet current or even future legal requirements in respect of exhaust emissions, catalytic converters mounted close to the engine are being increasingly used. Because of the short mixing section from the internal combustion engine's outlet valves to the catalytic converter, these sometimes require very tight tolerances in the air/fuel ratio in the respective cylinders of the internal combustion engine, namely in the ratio to one another relative to an exhaust bank, compared to mounting the catalytic converter away from the engine, e.g. in an underfloor arrangement.

DE 199 03 721 C1 discloses a method for a multi-cylinder internal combustion engine for controlling, in a cylinder selective manner, an air/fuel mixture to be combusted, wherein the lambda values for different cylinders or cylinder groups are separately sensed and controlled. For this purpose a probe analysis unit is provided in which the exhaust probe signal is analyzed in a time resolved manner to determine a cylinder-selective lambda value for each cylinder of the internal combustion engine. Each cylinder is assigned an individual controller which is implemented as a PI or PID controller whose controlled variable is an individual cylinder lambda value and whose command variable is a individual cylinder lambda setpoint. The manipulated variable of the respective controller then influences the injection of fuel into the assigned cylinder.

The effectiveness of individual cylinder lambda control is critically dependent on how precisely the exhaust probe's measurement signal is correlated with the exhaust gas of the respective cylinder. During operation of the exhaust probe, its response may vary and therefore also the degree of precision of the assignment of the probe measurement signal to the exhaust gases of the particular cylinder.

SUMMARY OF INVENTION

The object of the invention is to create a method for adapting the acquisition of an exhaust probe measurement signal which will enable an internal combustion engine in which the exhaust probe can be disposed to be simply and precisely controlled over a long period of operation.

This object is achieved by the features of the claims. Advantageous embodiments of the invention are set forth in the claims.

The invention is characterized by a method and a corresponding device for adapting the acquisition of a measurement signal of an exhaust probe. The exhaust probe is disposed in an internal combustion engine having a plurality of cylinders and fuel-metering injection valves associated with said cylinders. The exhaust probe is disposed in an exhaust tract of the internal combustion engine and its measurement signal is characteristic for the air/fuel ratio in the particular cylinder.

The measurement signal is acquired at a predefined crankshaft angle relative to a reference position of the piston of the particular cylinder and is assigned to said cylinder. By means of a controller, a manipulated variable for influencing the air/fuel ratio in the particular cylinder is generated as a function of the measurement signal acquired for said cylinder.

The predefined crankshaft angle is adapted according to a performance index based on uneven running of a drive shaft of the internal combustion engine. The performance index involves a suitable calculation rule which encompasses uneven running.

The invention is based on the knowledge that the performance index, which is based on uneven running of the drive shaft of the internal combustion engine, can simply and very quickly indicate a necessary adaptation of the predefined crankshaft angle, i.e. that, contingent upon the performance index, any such necessary adaptation can be detected at a very early stage, thereby enabling undesirable pollutant emission caused by erroneous determinations of the individual cylinder air/fuel ratio to be strictly limited. Moreover, uneven running is often calculated anyway for other functions for controlling the internal combustion engine, which means that it can be resorted to without any significant additional cost/complexity.

According to an advantageous embodiment of the invention, the performance index is determined on the basis of individual cylinder uneven running values. This has the advantage that it is particularly characteristic for the effectiveness of the selection of the respective predefined crankshaft angle and of its corresponding correlation with the respective individual cylinder air/fuel ratio.

According to another advantageous embodiment of the invention, the performance index is determined by taking the sum of the absolute values of the individual cylinder uneven running values. This is particularly simple and characteristic for the effectiveness of determination of the respective individual cylinder air/fuel ratio.

In this connection it is particularly advantageous if the performance index includes taking the gradient of the sum of the absolute values of the individual cylinder uneven running values. This provides a simple means of detecting drift away from a stable control range to an unstable control range at a very early stage.

According to another advantageous embodiment of the invention, the performance index is determined on the basis of manipulated variables of the controllers assigned to the cylinders. In this way it can be ensured with a high degree of probability that adapting the predefined crankshaft angle is either necessary or not, thus enabling possible fault sources which are not attributable to the predefined crankshaft angle to be eliminated by determining the performance index both on the basis of uneven running of the drive shaft and of the manipulated variables of the controllers assigned to the cylinders. Also in this connection it is advantageous if absolute values of characteristic quantities for the manipulated variables of the controllers assigned to the cylinders are summed and possibly the gradient of this sum is taken.

According to another advantageous embodiment of the invention, the predefined crankshaft angle is adapted as a function of an instability criterion of the controller. The instability criterion is fulfilled if the relevant controller operates in an unstable manner. In this way, particularly reliable adaptation can be ensured and thus redundancy for detecting the necessary adaptation of the predefined crankshaft angle can ultimately be provided.

According to another advantageous embodiment of the invention, the instability criterion depends on the manipulated variable(s) of the controller assigned to the particular cylinder and/or other controllers which are assigned to other cylinders. Thus the measurement signal can be adapted particularly simply and quickly.

In another advantageous embodiment of the invention, the instability criterion is fulfilled if, for a predefined time, the manipulated variable(s) is (are) equal to its (their) maximum limit value to which it (they) is (are) limited by the controller(s), or if the manipulated variable(s) is (are) equal to its (their) minimum limit value to which it (they) is (are) limited by the controller(s). This makes it simple to detect whether control is unstable and then for corresponding adaptation of the predefined crankshaft angle to take place.

In another advantageous embodiment of the invention, to fulfill the stability criteria it is required that, for the predefined time, all the manipulated variables be equal to their maximum limit value to which there are limited by the controllers, or equal to their minimum limit value to which there are limited by the controllers, this applying to the manipulated variables of all the cylinders. This enables control instability to be detected particularly reliably and especially prevents a component fault, e.g. that of an injection valve, from being erroneously detected as control instability.

In another advantageous embodiment of the invention, to fulfill the instability criterion it is required that, in the case of an even number of cylinders, one half of the manipulated variables be equal to the maximum limit value and the other half to the minimum limit value and that, in the case of an odd number of cylinders, a first number of manipulated variables be equal to the maximum limit value and a second number of manipulated variables be equal to the minimum limit value, the first number differing from the second by one and the sum of the first and second number being equal to the odd number of cylinders. This is based on the knowledge that this is characteristic for unstable control in the case of an even number of cylinders and correspondingly for an odd number of cylinders.

In another advantageous embodiment of the invention, an injection valve or actuator fault which only affects the air supply to the respective cylinder is deemed to be present if, for a predefined time, the manipulated variable of said cylinder is equal to its maximum limit value to which it is limited by the controller, or equal to its minimum limit value to which it is limited by the controller, and at least one manipulated variable which is assigned to another cylinder is not equal to the maximum limit value or the minimum limit value. This additionally enables an injection valve fault to be detected and the crankshaft angle for measurement signal acquisition not to be changed erroneously.

In another advantageous embodiment of the invention, the instability criterion is fulfilled if at least the manipulated variable assigned to a cylinder oscillates with an amplitude which is greater than a predefined threshold value amplitude. This enables control instability to be reliably detected particularly in the case of an odd number of cylinders.

In another advantageous embodiment of the invention, the controllers each incorporate an observer which determines a state variable as a function of the acquired exhaust probe measurement signals, an observer variable characterizing the state variable being fed back and the instability criterion depending on one or more of the state variables. This enables the instability criterion to be particularly simple.

Further advantageous embodiments of the invention in respect of the state variable or variables correspond to those relating to the manipulated variable or variables and exhibit corresponding advantages.

It is also advantageous if the predefined crankshaft angle is adapted with an increment corresponding to a predefined fraction of the expected control stability range. The fraction is preferably selected as ⅕ of the expected control stability range. Thus the predefined crankshaft angle can be very rapidly adapted, namely according to the increment selected, and at the same time little computing complexity is required, as it is only necessary that the stability range be attained in the result.

If the measurement signal of the exhaust probe is characteristic for the air/fuel ratio in the particular cylinder of a first part of all the cylinders and another exhaust probe is provided whose measurement signal is characteristic for the air/fuel ratio in the particular cylinder of a second part of all the cylinders, the acquisition of the measurement signal of the exhaust probe and of the other exhaust probe is advantageously adapted separately and relative in each case to the first part and second part respectively of all the cylinders.

BRIEF DESCRIPTION OF THE DRAWINGS

Exemplary embodiments of the invention will now be explained with reference to the accompanying schematic drawings in which.

Elements of identical design and function are provided with the same reference numerals throughout the figures.

DETAILED DESCRIPTION OF INVENTION

Figure 1:
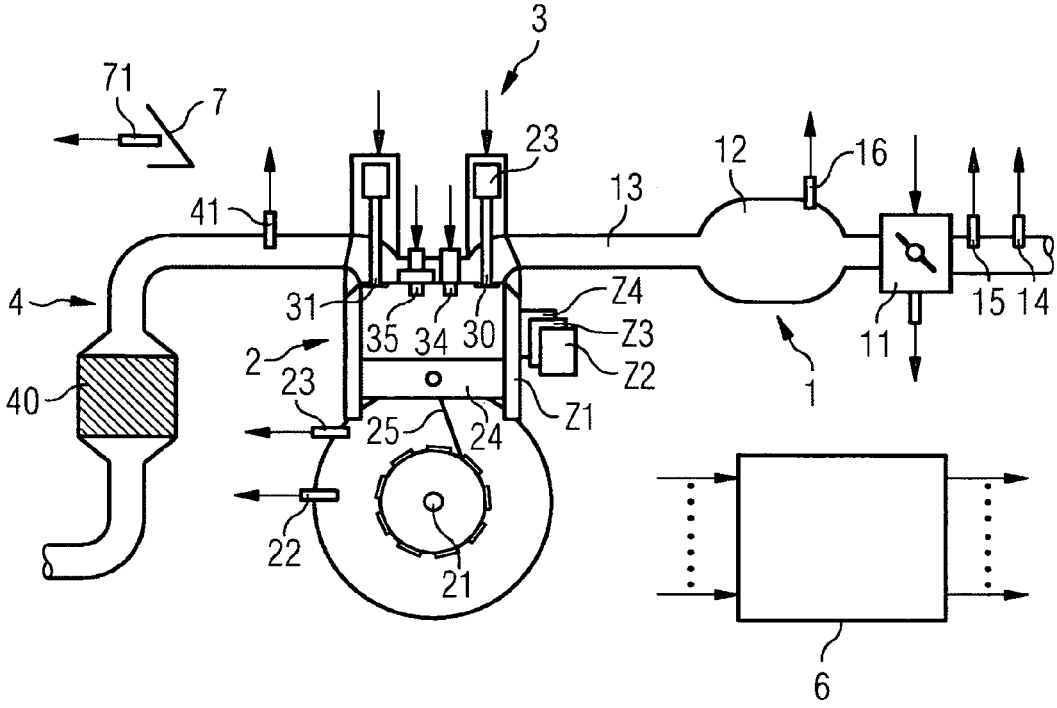
FIG. 1 shows an internal combustion engine with a control device.

An internal combustion engine (FIG. 1) comprises an intake tract 1, a cylinder block 2, a cylinder head 3 and an exhaust tract 4. The intake tract 1 preferably comprises a throttle valve 11, also a plenum 12 and an intake pipe 13 leading to a cylinder Z1 via an inlet runner into the cylinder block 2. The cylinder block 2 additionally comprises a crankshaft 21 which is linked to the piston 24 of the cylinder Z1 via a connecting rod 25.

The cylinder head 3 incorporates a valve operating mechanism comprising a gas inlet valve 30, a gas outlet valve 31 and valve actuators 32, 33. The cylinder head 3 additionally contains an injection valve 34 and a spark plug 35. Alternatively the injection valve can also be disposed in the intake runner.

The exhaust tract 4 contains a catalytic converter 40 which is preferably implemented as a three-way converter. An exhaust gas recirculating line can run from the exhaust tract 4 back to the intake tract 1, in particular to the plenum 12.

There is additionally provided a control device 6 to which sensors are assigned which detect various measured variables and determine the measured value of the measured variable in each case. The control device 6 controls the final control elements by means of corresponding actuators as a function of at least one of the measured variables.

The sensors are a pedal position sensor 71 which detects the position of an accelerator pedal 7, a mass airflow sensor 14 which detects a mass airflow upstream of the throttle valve 11, a temperature sensor 15 which detects an intake air temperature, a pressure sensor 16 which detects an intake pipe pressure, a crankshaft angle sensor 22 which detects a crankshaft angle to which an engine speed N is then assigned, another temperature sensor 23 which detects a coolant temperature, a camshaft angle sensor which detects the camshaft angle and an exhaust probe 41 which detects a residual oxygen content of the exhaust gas and whose measurement signal is characteristic for the air/fuel ratio in the cylinder Z1 prior to combustion of the fuel. The exhaust probe 41 is preferably implemented as a linear lambda probe and thus produces, over a wide air/fuel ratio range, a measurement signal that is proportional thereto.

Depending on the embodiment of the invention, any subset of the abovementioned sensors can be present or additional sensors can also be present. Thus, for example, a cylinder pressure sensor can be present which detects a pressure in the combustion chambers of the cylinders.

The final control elements can be for example, the throttle valve 11, the gas inlet and outlet valves 30, 31, the injection valve 34 or the spark plug 35.

In addition to the cylinder Z1, further cylinders Z2-Z4 are preferably also provided to which corresponding final control elements are then also assigned. Preferably each exhaust cylinder bank is assigned an exhaust probe. Thus, for example, the internal combustion engine may comprise six cylinders, three of which are assigned to an exhaust bank and correspondingly to an exhaust probe 41.

Figure 2:
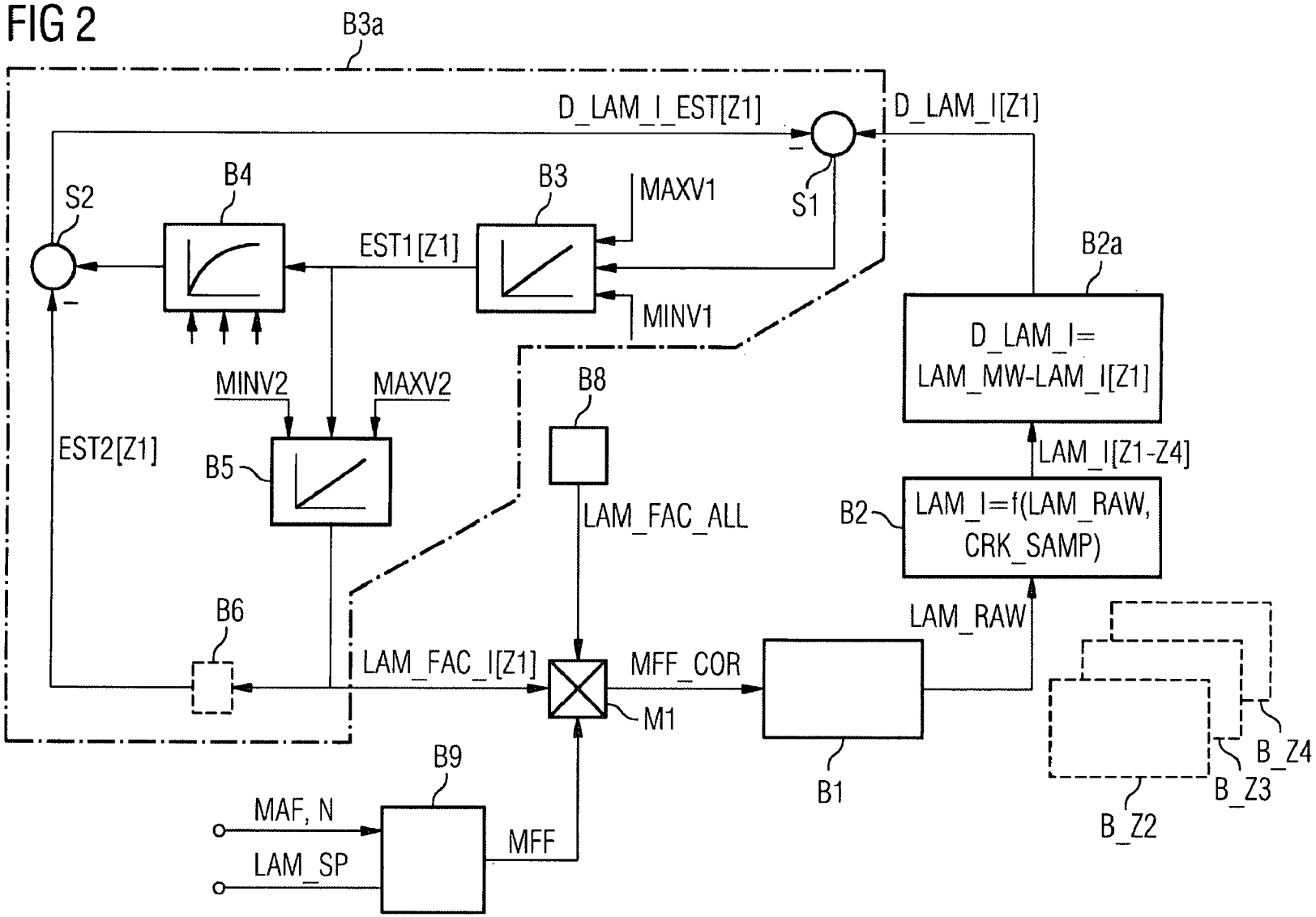
FIG. 2 shows a block diagram of the control device.

A block diagram of parts of the control device 6, which can also be termed an apparatus for controlling the internal combustion engine, is shown in FIG. 2.

A block B1 corresponds to the internal combustion engine. An air/fuel ratio LAM_RAW detected by the exhaust probe 41 is fed to a block B2. In said block B2, at predefined crankshaft angles CRK_SAMP relative to a reference position of the piston of the respective cylinder Z1 to Z4, the current air/fuel ratio detected at that point in time, which is derived from the measurement signal of the exhaust probe 41, is then assigned to the air/fuel ratio of the respective cylinder Z1 to Z4, thereby assigning the air/fuel ratio LAM_I [Z1-Z4] which was detected on an individual cylinder basis.

The reference position of the particular cylinder 24 is preferably its top dead center. The predefined crankshaft angle CRK_SAMP is, for example, continuously applied for initial commissioning of the internal combustion engine and is subsequently adapted if necessary using the programs described below.

In a block B2*a*, a mean air/fuel ratio LAM_MW is determined by averaging the air/fuel ratios LAM_I [Z1-Z4] acquired on an individual cylinder basis. Also in the block B2*a*, an actual value D_LAM_I [Z1] of an individual cylinder air/fuel ratio deviation is determined from the difference between the mean air/fuel ratio LAM_MW and the air/fuel ratio LAM_I [Z1] acquired on an individual cylinder basis. This is then fed to a controller represented by the block B3*a*.

At a summing point S1 the difference between the actual value D_LAM_I[Z1] and an estimated value D_LAM_I_EST [Z1] of the individual cylinder air/fuel ratio deviation is determined and then assigned to a block B3 which is part of an observer and contains an integrator which integrates the variable present at its input. The integrator of the block B3 then provides a first estimated value EST1 [Z1] at its output. In the integrator of block B3, the first estimated value EST1 [Z1] is limited to a minimum limit value MINV1 and a maximum limit value MAXV1 which are preferably predefined in a fixed manner.

The first estimated value EST1[Z1] is then fed, on the one hand, to a lag element also forming part of the observer, said lag element being embodied in the block B4. The lag element is preferably implemented as a PT1 element. If necessary, the first estimated values EST1[Z2-Z4] relating to the other cylinders [Z2-Z4] are also fed to the lag element. The first estimated value EST1[Z1] constitutes a state variable of the observer.

The first estimated value EST1[Z1] is also fed to a block B5 in which another integrator is embodied which integrates the first estimated value EST1[Z1] and then produces at its output an individual cylinder lambda control factor LAM_FAC_I [Z1]. In the integrator of the block B5, the individual cylinder lambda control factor LAM_FAC_I [Z1] is limited to a maximum limit value MAXV2 and a minimum limit value MINV2.

In a block B6, a second estimated value EST2 [Z1] is determined as a function of an individual cylinder lambda control factor LAM_FAC_I [Z1]. This can be done particularly simply by setting the second estimated value EST2 [Z1] equal to the individual cylinder lambda control factor LAM_FAC_I [Z1]. At the summing point S2, the difference is then taken between the first estimated value EST1 [Z1] filtered via the lag element of the block B4 and the second estimated value EST2 [Z1] and fed back to the summing point S1 as the estimated value D_LAM_I_EST [Z1] of the individual cylinder air/fuel ratio deviation where it is subtracted from the actual value D_LAM_I [Z1] of the respective individual cylinder air/fuel ratio deviation and thus fed back and then reapplied to the block b3.

In a block B8, a lambda controller is provided whose command variable is an air/fuel ratio predefined for all the cylinders of the internal combustion engine and whose controlled variable is the mean air/fuel ratio LAM_MW. The manipulated variable of the lambda controller is a lambda control factor LAM_FAC_ALL. The lambda controller therefore has the task of setting the predefined air/fuel ratio across all the cylinders Z1 to Z4 of the internal combustion engine.

Alternatively, this can also be achieved by determining, in the block B2, the actual value D_LAM_I of the individual cylinder air/fuel ratio deviation from the difference between the air/fuel ratio predefined for all the cylinders Z1 to Z4 of the internal combustion engine and the individual cylinder air/fuel ratio LAM_I[Z1-Z4]. In this case the third controller of the block B8 can be omitted.

In a block B9, a mass of fuel MFF to be metered-in is determined as a function of a mass air flow MAF into the respective cylinder Z1 to Z4 and possibly of the engine speed N and a setpoint value LAM_SP of the air/fuel ratio for all the cylinders Z1-Z4.

At the multiplying point M1, a corrected mass of fuel MFF_COR to be metered-in is determined by multiplying the mass of fuel MFF to be metered-in, the lambda control factor LAM_FAC_ALL and the individual cylinder lambda control factor LAM_FAC_I[Z1]. An actuating signal with which the relevant injection valve 34 is controlled is then generated as a function of the corrected mass of fuel MFF_COR to be metered-in.

In addition to the controller structure shown in FIG. 2, for each further cylinder Z1 to Z4 corresponding controller structures B_Z2 to B_Z4 are provided for the other cylinders Z2 to Z4.

The mean air/fuel ratio LAM_MW is preferably determined separately for the cylinders of each exhaust bank.

Alternatively, a proportional element can also be embodied in the block B5.

A program (FIG. 3) for adapting the acquisition of the measurement signal of the exhaust probe 41 is initiated in a step S1, preferably contemporaneously with startup of the internal combustion engine. In the step S1, variables are likewise initialized.

In a step S2 it is checked whether the individual cylinder lambda control factor LAM_FAC_I [Z1] which is assigned to the cylinder Z1 is the same as the maximum limit value MAXV2 or a minimum limit value MINV2, and remains so for a predefined period of e.g. five and ten seconds, or whether the amplitude AMP of the individual cylinder lambda control factor LAM_FAC_I [Z1] which is assigned to the cylinder Z1 exceeds a predefined threshold amplitude AMP_THR. If this is not the case, an instability criterion is deemed not to be fulfilled and processing is continued in a step S4 in which the program is interrupted for a predefined waiting time T_W before the step S2 condition is re-checked.

If on the other hand the step S2 condition is fulfilled, the instability criterion is deemed to be fulfilled and the predefined crankshaft angle CRK_SAMP relative to the reference position of the piston 24 of the respective cylinder Z1 to Z4 at which the measurement signal of the exhaust probe 41 is acquired and assigned to the relevant cylinder is adapted in the step S6, preferably by the predefined crankshaft angle CRK_SAMP being either increased or reduced by a predefined change angle D. The change angle D is preferably a predefined fraction of the expected crankshaft angle range within which control is stable. Said expected crankshaft angle range is preferably determined empirically, namely when the internal combustion engine is new. For a four-cylinder internal combustion engine it can be 180°, for example. The change angle D is preferably a large angle in relation to the crankshaft angle range, e.g. 20% of the crankshaft angle range, i.e. approximately 40° crankshaft angle. The direction of adaptation of the predefined crankshaft angle CRK_SAMP is preferably determined by two or more consecutive executions of the steps S2 and S6 taking into account the starting state, i.e. the instability criterion, with different signs of the change angle D.

The preferably large increment of the adaptation of the predefined crankshaft angle CRK_SAMP as a result of the large change angle D enables the stable control range to be found within very few executions of the steps S2 and S6, a range which is characterized in that the instability criterion of step S2 is not fulfilled.

Figure 4:
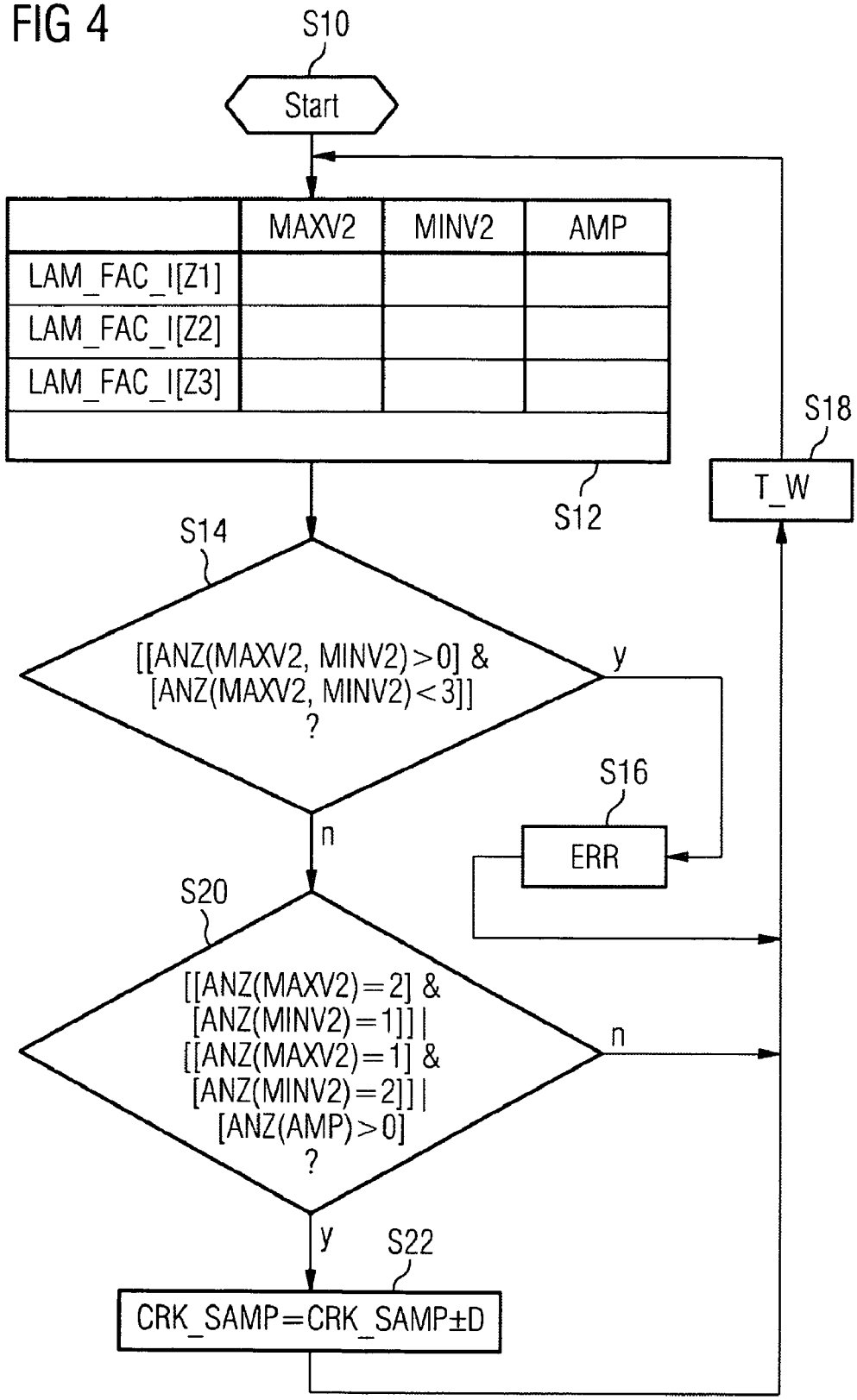
FIG. 4 shows another program for adapting the acquisition of the exhaust probe measurement signal.

A second embodiment of a program for adapting the acquisition of the measurement signal of the exhaust probe 41 is shown with reference to FIG. 4. The program is initiated in a step S10 in which variables are initialized where necessary. It is typically described for an internal combustion engine in which three cylinders Z1-Z3 are assigned to an exhaust probe 41. This can be the case, for example, for an internal combustion engine with three cylinders Z1-Z3 or also for an internal combustion engine with six cylinders in which the exhaust ports of three cylinders Z1-Z3 are each routed to a exhaust probe 41. With this type of internal combustion engine with six cylinders the program is then executed once in parallel for each three cylinders, in accordance with the following steps. The program is, however, also suitable for execution if the relevant exhaust probe 41 is assigned to a different number of cylinders, in which case the conditions are then adapted according to this number.

In the step S12, the individual cylinder lambda control factors LAM_FAC_I [Z2], LAM_FAC_I [Z2], LAM_FAC_I [Z3] which are assigned to the cylinders Z1 to Z3 are checked to ascertain whether they assume the maximum limit value MAXV2 or the minimum limit value MINV2 for the predefined period, or whether their time characteristic oscillates with an amplitude AMP which is greater than the predefined threshold amplitude AMP_THR.

In a simple embodiment of step S12, the amplitude AMP can also be determined in each case by detecting the maximum and minimum values of the time characteristic of the individual cylinder lambda control factor LAM_FAC_I [Z1 to Z3] occurring during the predefined period and setting their difference equal to the amplitude AMP.

In a step S14, it is then checked whether the number of individual cylinder lambda control factors LAM_FAC_I [Z1 to Z3] which were detected in step S12 as being equal to the maximum value MAXV2 or minimum value MINV2 for the predefined period, is greater than zero and at the same time less than three.

If this is the case, a component fault is detected in a step S16. This component can be the respective injection valve 34 of the cylinder or cylinders Z1-Z3 for which the individual cylinder lambda control factor LAM_FAC_I [Z1 to Z3] has assumed the maximum value MAXV2 or the minimum value MINV2 for the predefined period. This is based on the knowledge that if some, but not all, of the individual cylinder lambda control factors LAM_FAC_I [Z1 to Z3] each assigned to an exhaust probe 41 assume the maximum value MAXV2 or the minimum value MINV2, this is not to be attributed to control instability but to a fault in a component. The component can be the particular injection valve 34 or also a final control element which exclusively influences the air supply to the respective cylinder Z1-Z3. Such a final control element can be, for example, the inlet valve 30 or also a so-called pulse charging valve.

In the step S16, emergency running of the internal combustion engine can then be controlled, for example, or if necessary measures can also be taken to rectify the component fault. After the step S16, processing is continued in the step S18 in which the program is interrupted for the predefined waiting time T_W before processing is resumed in the step S12.

If, on the other hand, the condition of step S14 is not fulfilled, an instability criterion is checked in a step S20. In said step S20, it is checked whether the number ANZ of individual cylinder lambda control factors LAM_FAC_I [Z1 to Z3] which have assumed the maximum limit value MAXV2 for the predefined period in the step S12 is equal to two and the corresponding number of those which have assumed the minimum limit value MINV2 is equal to one, or the number ANZ of those which have assumed the maximum limit value MAXV2 is equal to one and the number of those which have assumed the minimum limit value MINV2 is equal to two, or the number of individual cylinder lambda control factors LAM_FAC_I [Z1 to Z3] whose amplitude AMP is greater than the threshold amplitude AMP_THR is greater than zero.

If the condition of step S20 and thereby of the instability criterion is not fulfilled, processing is continued in the step S18.

The condition of step S20 is based on the knowledge that, in the event of control instability for an odd number of cylinders, all the individual cylinder lambda control factors LAM_FAC_I [Z1 to Z3] assume either the maximum limit value MAXV2 or the minimum limit value MINV2 and, in addition, one part assumes the minimum limit value MINV2 and the other part assumes the maximum limit value MAXV2, the number of those which assume the maximum limit value MAXV2 only differing by one from the number which assume the minimum limit value MINV2. For an even number of cylinders, in this case precisely one half of the individual cylinder lambda control factors LAM_FAC_I [Z1 to Z3] are equal to the maximum limit value MAXV2 and the other half are equal to the minimum limit value MINV2. Tests have shown that particularly in the case of an odd number of cylinders, control instability is also present if the amplitude AMP of the oscillation of the characteristic of the respective individual cylinder lambda control factors LAM_FAC_I [Z1 to Z3] is greater than the predefined threshold amplitude AMP_THR, which preferably corresponds to approximately two thirds of the difference between the maximum limit value MAXV2 and the minimum limit value MINV2.

If the condition of step S20 is fulfilled, the predefined crankshaft angle CRK_SAMP is adapted in a step S22 in accordance with step S6. After step S22, program execution is continued in step S18.

Figure 5:
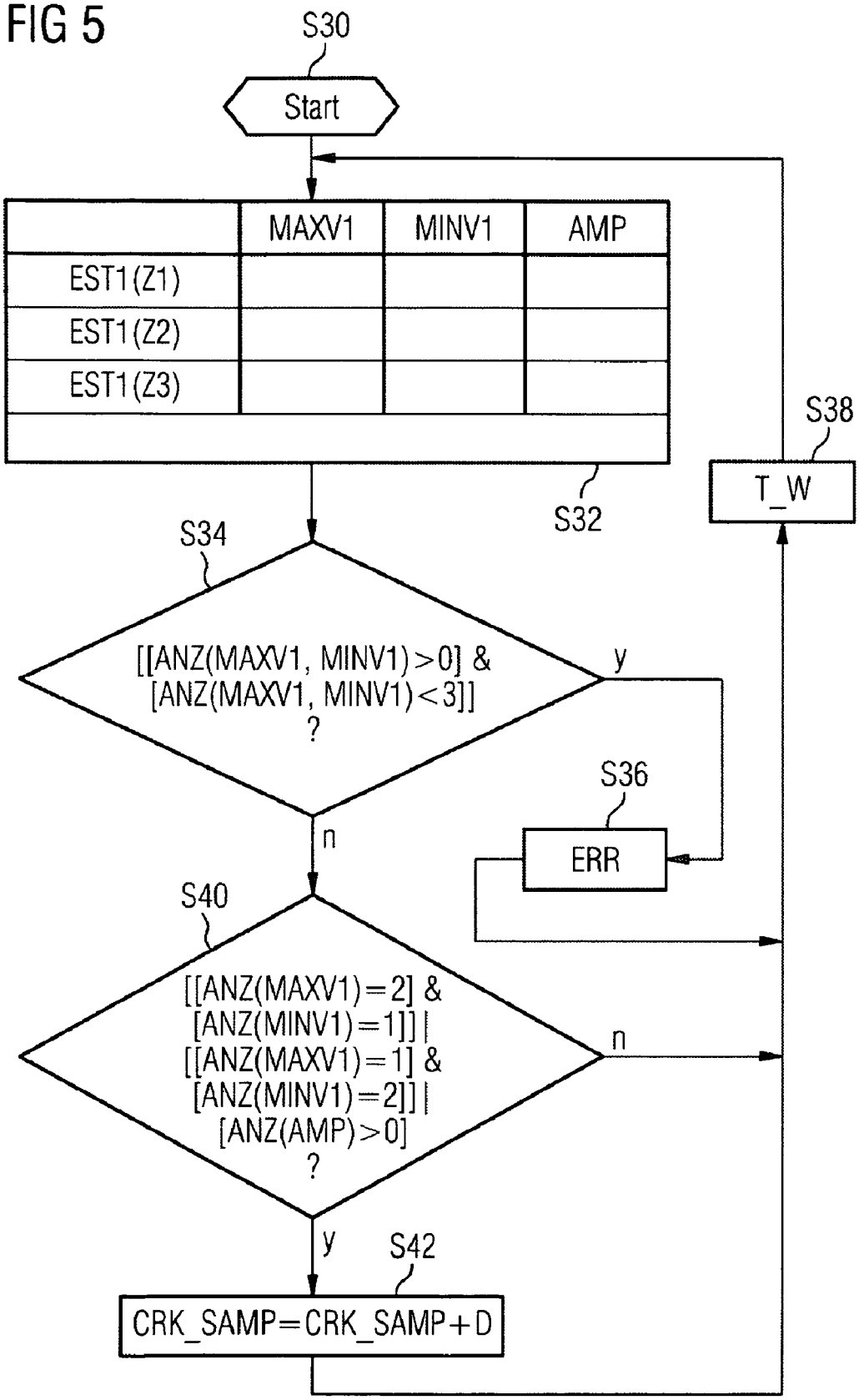
FIG. 5 shows another flowchart of a program for adapting the acquisition of the exhaust probe measurement signal and FIG. 6 shows another flowchart of a program for adapting the acquisition of the exhaust probe measurement signal.

Another embodiment of the program for adapting the acquisition of the measurement signal of the exhaust probe 41 is described below with reference to FIG. 5, with only the differences with respect to the embodiment according to FIG. 4 being explained. The program is initiated in a step S30. A step S32 is then executed which is similar to the step S12. In contrast to the step S12, the time characteristics of the first estimated value EST1 [Z1 to Z3] of the respective controller assigned to the particular cylinder Z1 to Z4 are examined to ascertain whether, for the predefined period, they assume the maximum limit value MAXV1 or the minimum limit value MINV1 or whether their time characteristic oscillates with an amplitude AMP which is greater than the threshold amplitude AMP_THR.

Alternatively in said step S32, instead of the respective first estimated value EST1, the first estimated value EST1 filtered by means of the block B4 can be examined.

The steps S34 and S40 correspond to the steps S14 and S20 respectively, with the proviso that here the conditions are referred to the respective first estimated values EST1 [Z1 to Z3] instead of to the individual cylinder lambda control factors LAM_FAC_I [Z1 to Z3]. Steps S36, S38 and S42 correspond to steps S16, S18 and S22.

Figure 3:
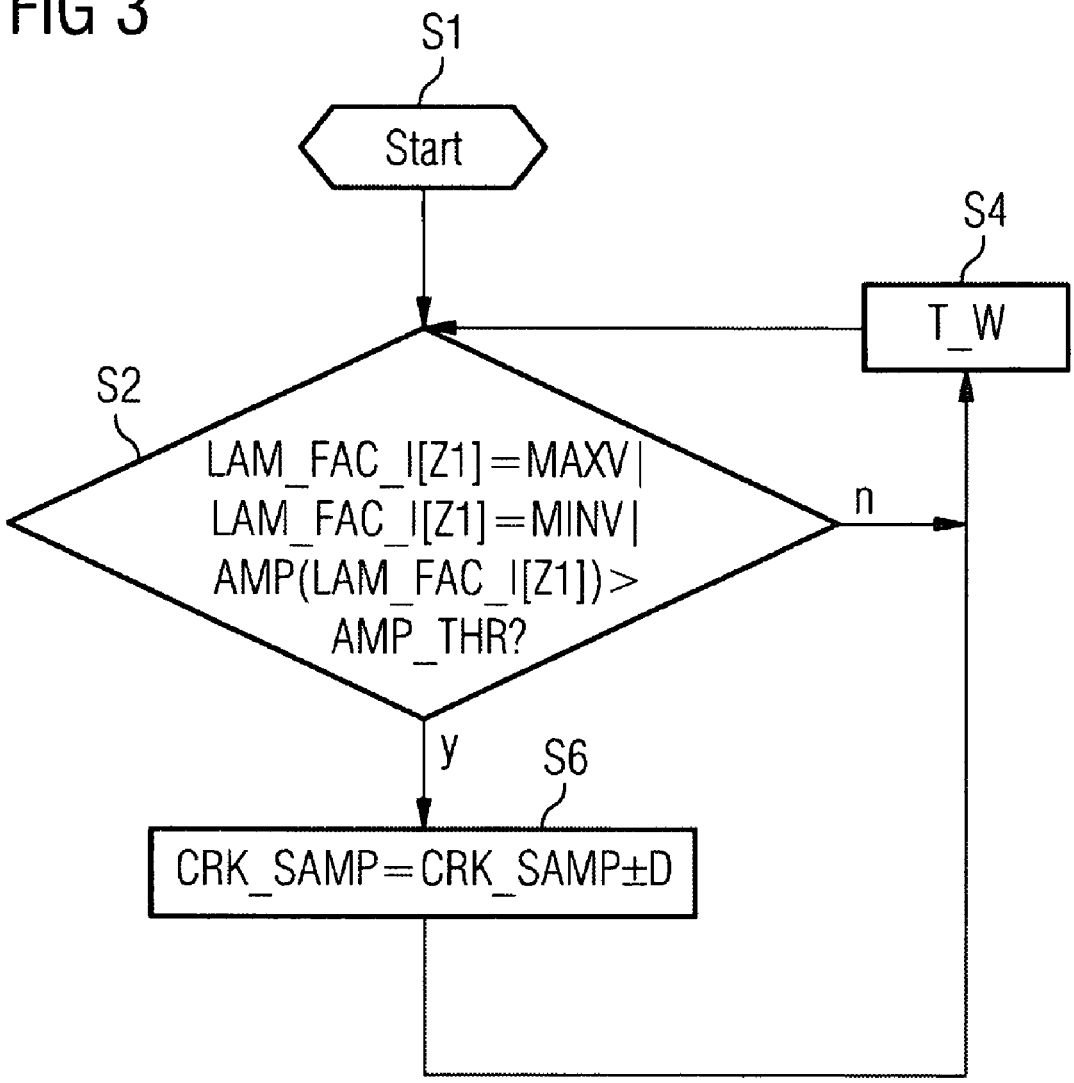
FIG. 3 shows a first flowchart of a program for adapting the acquisition of an exhaust probe measurement signal.
Figure 6:
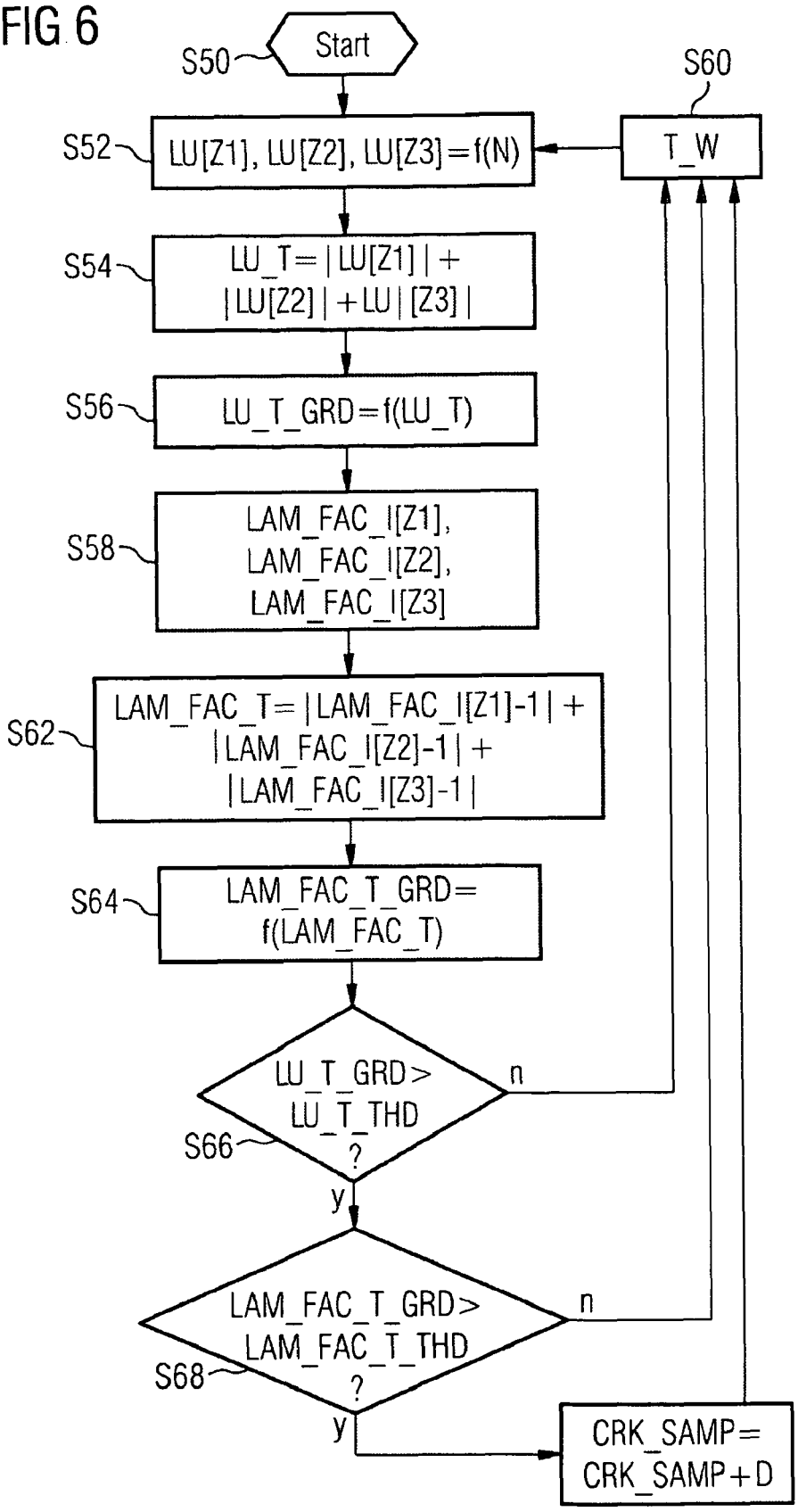

Another program for adapting the acquisition of the measurement signal of the exhaust probe 41 is initiated in a step S50, preferably contemporaneously with startup of the internal combustion engine (FIG. 6). In the step S50, variables are initialized if necessary. The program according to FIG. 6 is executed in the control device 6 irrespectively of whether one or more of the programs according to FIGS. 3 to 5 are also executed. Preferably, however, at least one of the embodiments of the programs according to FIGS. 3 to 5 is executed in the control device 6 effectively in parallel with execution of the program according to FIG. 6 during operation of the internal combustion engine.

In a step S52, uneven running of a drive shaft of the internal combustion engine is determined. The drive shaft of the internal combustion engine is preferably the crankshaft 21. The uneven running is preferably determined as a function of the measurement signal of the crankshaft angle sensor 22. However, it can also be determined, for example, as a function of a measurement signal of the cylinder pressure sensor.

The uneven running is characteristic for a true, i.e. uniform, rotational movement of the crankshaft 21 or a rotational movement deviating therefrom. In the step S52, individual cylinder uneven running values LU[Z1], LU[Z2], LU[Z3] are preferably determined. The individual cylinder uneven running values LU[Z1], LU[Z2], LU[Z3] are preferably determined by taking the gradient of the engine speeds N in two consecutive cylinder segments. In this context, gradient is to be understood as meaning the change of the engine speed over time. Cylinder segment refers to the crankshaft angle range within an operating cycle of the internal combustion engine during which the respective torque produced is to be assigned to each cylinder Z1-Z4. In the case of a four-stroke internal combustion engine, the crankshaft angle range which a cylinder assumes is 720° divided by the number of cylinders. The uneven running value can thus be determined particularly simply. It is a characteristic measure of the deviation of the individual torque contributions which are produced by the respective cylinders by combustion of the air/fuel mixture.

In a step S54, an uneven running term LU_T is determined by taking the sum of the absolute values of the individual cylinder uneven running values. The individual cylinder uneven running values are preferably referred to a mean uneven running value for all the cylinders or the cylinders which are assigned to an exhaust bank. They are therefore representative for the uneven running deviations of the particular cylinders Z1-Z3. The uneven running term LU_T therefore assumes correspondingly larger values if the deviations of the individual cylinder uneven running values LU[Z1-Z3] increase.

In a step S56, the gradient LU_T_GRD of the uneven running terms LU_T is determined. For this purpose, uneven running terms LU_T correspondingly determined during previous executions of the steps S52 and S54 are then preferably used.

In a step S58, the individual cylinder lambda control factors LAM_FAC_I[Z1-Z3] are determined. They are in particular interrogated by the block B3*a* according to FIG. 2. The individual cylinder lambda control factors LAM_FAC_I [Z1-Z3] are preferably determined effectively in parallel with the individual cylinder uneven running values LU[Z1-Z3], i.e. preferably within an operating cycle.

In a step S62, a lambda term LAM_FAC_T is formed by taking the sum of the individual cylinder lambda control factors LAM_FAC_I[Z1-Z3], namely of the absolute values of their deviations from a neutral value which is preferably one.

In a step S64, a gradient LAM_FAC_T_GRD of the lambda term LAM_FAC_T is taken, preferably as a function of the currently determined lambda term LAM_FAC_T and at least one lambda term LAM_FAC_TS determined during a previous execution of the step 62.

In a step S66, it is then checked whether the gradient LU_T_GRD of the uneven running term LU_T is greater than a predefined uneven running threshold value LU_T_THD which is determined by suitable tests or simulations and is preferably permanently stored in a data memory of the control device If the condition of the step S66 is not fulfilled, execution continued in a step S60 in which the program waits for a predefined waiting time T_W or a possibly predefined crankshaft angle before processing is resumed in the step S52.

If the condition of the step S66 is not fulfilled, however, it is checked in a step S68 whether the gradient LAM_FAC_T_GRD of the lambda term LAM_FAC_T is greater than a predefined lambda threshold value LAM_FAC_T_THD. The lambda threshold value is preferably likewise determined by tests or simulations and stored in a data memory of the control device 6. If the condition of the step S68 is not fulfilled, processing is continued in the step S60. On the other hand, if the condition of the step S68 is fulfilled, processing is continued in the step S70. The step S70 corresponds to the step S6. Therefore, adaptation of the predefined crankshaft angle CRK_SAMP then takes place in the step S70.

In a simpler embodiment of the program, the step S70 can also be executed if at least the condition of the step S58 is fulfilled. However, if the condition of the step S68 must additionally be fulfilled for executing step S70, the situation whereby exceedance of the gradient LU_T_GRD of the uneven running term LU_T is traced to a cause other than an incorrectly predefined crankshaft angle but the predefined crankshaft angle CRK_SAMP is nevertheless adapted can be prevented with a higher degree of reliability. Alternatively, in the step S66 or also in the step S68, instead of the gradient LU_T GRD or LAM_FAC_T_GRD, the respective uneven running term LU_T or the corresponding lambda term LAM_FAC_T can also be compared with a suitable threshold value.

It has been shown that the program in FIG. 6 can be used to detect at a very early stage any necessary adaptation of the predefined crankshaft angle CRK_SAMP, thereby enabling pollutant emissions to be minimized. This is particularly advantageous if the injection valves and here in particular their drives have a very large variation range. This is the case in particular for piezo actuators for injection valves. Because of these high variation tolerances, a very large cylinder-selective lambda control range must then be permitted, i.e. the individual cylinder lambda control factors LAM_FAC_I[Z1-Z4] must be allowed to deviate e.g. up to fifteen or twenty percent from a neutral value within the control stability range. In this case, by means of the program in FIG. 6, any necessary adaptation of the predefined crankshaft angle CRK_SAMP is detected and carried out at a particularly early stage compared to the programs according to FIGS. 3 to 5. However, by executing at least one of the programs in FIGS. 3 to 5 in parallel, the certainty of detecting a necessary execution of adaptation of the predefined crankshaft angle CRK_SAMP can be improved still further, thereby ensuring low engine emissions even more reliably.

The invention claimed is:

1. A device for adapting the acquisition of a measurement signal of an exhaust probe associated with an internal combustion engine where the internal combustion engine has a plurality of cylinders and fuel-metering injection valves assigned to the cylinders and the exhaust probe is disposed in an exhaust tract of the engine and the exhaust probe measurement signal is characteristic of the air/fuel ratio in the respective cylinder, comprising:

a measurement acquisition device that acquires the measurement signal at a predefined crankshaft angle relative to a reference position of a piston of the respective cylinder and is assigned to the particular cylinder of the engine;

a controller that generates a manipulated variable for influencing the air/fuel ratio in the respective cylinder of the engine as a function of the measurement signal acquired for the respective cylinder; and an adaptation device that adapts the predefined crankshaft angle as a function of a performance index based on uneven running of a drive shaft of the internal combustion engine.

2. A method for adapting the acquisition of a measurement signal of an exhaust probe associated with an internal combustion engine where the internal combustion engine has a plurality of cylinders and fuel-metering injection valves assigned to the cylinders, comprising:

arranging the exhaust probe in an exhaust tract of the engine and a measurement signal of the exhaust probe is characteristic of the air/fuel ratio in the respective cylinder of the engine;

acquiring the measurement signal at a predefined crankshaft angle relative to a reference position of a piston of the respective cylinder and is assigned to the particular cylinder of the engine;

generating via a controller a manipulated variable for influencing the air/fuel ratio in the respective cylinder as a function of the measurement signal acquired for the respective cylinder; and adapting the predefined crankshaft angle as a function of a performance index based on uneven running of a drive shaft of the internal combustion engine.

3. The method as claimed in claim 2, wherein the performance index is determined on the basis of individual cylinder uneven running values.

4. The method as claimed in claim 3, wherein the performance index is determined on the basis of a sum of the absolute values of the individual cylinder uneven running values.

5. The method as claimed in claim 4, wherein determination of the performance index comprises calculating a gradient of the sum of the absolute values of the individual cylinder uneven running values.

6. The method as claimed in claim 5, wherein the performance index is determined based on manipulated variables of the controllers assigned to the cylinders.

7. The method as claimed in claim 6, wherein the predefined crankshaft angle is adapted according to an instability criterion of the controller.

8. The method as claimed in claim 7, wherein the instability criterion is based on the manipulated variable or variables of the controller assigned to the particular cylinder and/or other controllers assigned to the other cylinders.

9. The method as claimed in claim 8, wherein the instability criterion is fulfilled if the manipulated variables are equal to their maximum limit value to which they are limited by the controllers, or equal to their minimum limit value to which they are limited by the controllers.

10. The method as claimed in claim 8, wherein the instability criterion is fulfilled if, for the specified period, all the manipulated variables are equal to their maximum limit value to which they are limited by the controllers, or equal to their minimum limit value to which they are limited by the controllers, this applying to all the manipulated variables of all the cylinders.

11. The method as claimed in claim 10, wherein to fulfill the instability criterion it is required that in the case of an even number of cylinders one half of the manipulated variables be equal to the maximum limit value and the other half be equal to the minimum limit value and that in the case of an odd number of cylinders a first number of manipulated variables be equal to the maximum limit value and a second number of manipulated variables be equal to the minimum limit value, the first number differing from the second number by one and the sum of the first and second number being equal to the odd number of cylinders.

12. The method as claimed in claim 11, wherein the instability criterion is fulfilled if at least the manipulated variable assigned to a cylinder oscillates with an amplitude which is greater than a predefined threshold amplitude.

13. The method as claimed in claim 12, wherein the predefined crankshaft angle is adapted with an increment that corresponds to a predefined fraction of the expected stability range.

14. The method as claimed in claim 13, wherein the fraction corresponds to approximately ⅕ of the expected stability range.

15. The method as claimed in claim 14, wherein the measurement signal of the exhaust probe is characteristic for the air/fuel ratio in the particular cylinder of a first part of all the cylinders and wherein a further exhaust probe is provided whose measurement signal is characteristic for the air/fuel ratio in the particular cylinder of a second part of all the cylinders and wherein the acquisition of the measurement signal of the exhaust probe and of the further exhaust probe is then adapted separately and with respect to the first and the second part of all the cylinders in each case.

* * * * *